United States Patent [19]

Starkovich

[11] 4,364,775

[45] Dec. 21, 1982

[54] AQUEOUS OXIDATIVE SCRUBBER SYSTEMS FOR REMOVAL OF MERCURY

[75] Inventor: John A. Starkovich, Redondo Beach, Calif.

[73] Assignee: The United States of America as represented by the Secretary of the Army, Washington, D.C.

[21] Appl. No.: 275,531

[22] Filed: Jun. 19, 1981

[51] Int. Cl.[3] ..... C23G 1/02

[52] U.S. Cl. ..... 134/3; 134/41; 252/79.2; 423/109

[58] Field of Search ..... 423/109; 252/79.2; 134/3,41

[56] References Cited

U.S. PATENT DOCUMENTS

| | | | |
|---|---|---|---|
| 2,864,730 | 12/1958 | Kinder | 252/79.2 |
| 3,231,513 | 1/1966 | Graves | 134/3 |
| 3,676,219 | 7/1972 | Schroeder | 134/3 |
| 4,290,819 | 9/1981 | Cornwall | 134/3 |

OTHER PUBLICATIONS

Varmashenko et al., *Chemical Abstracts*, vol. 88 (1978), No. 125858.

Lo et al., *Chemical Abstract*, vol. 83 (1975), No. 136666t.

Krug et al., *Chemical Abstracts*, vol. 85 (1976), No. 365396.

Tutilova et al., as Abstracted in *Chemical Abstracts*, vol. 73 (1970), No. 104,843(a).

*Primary Examiner*—Brian E. Hearn

*Attorney, Agent, or Firm*—Nathan Edelberg; Robert P. Gibson; A. Victor Erkkila

[57] ABSTRACT

A scrubber system for removal and recovery of mercury from plated solid substrates comprising a solution of an alkali metal and ammonium dichromate or chromate salts and nitric acid, said salts and acid being in a weight ratio of about 0.2 to 200. A process for removing mercury from cartridge casings and live ammunition utilizing the oxidative scrubber system is also disclosed.

10 Claims, 1 Drawing Figure

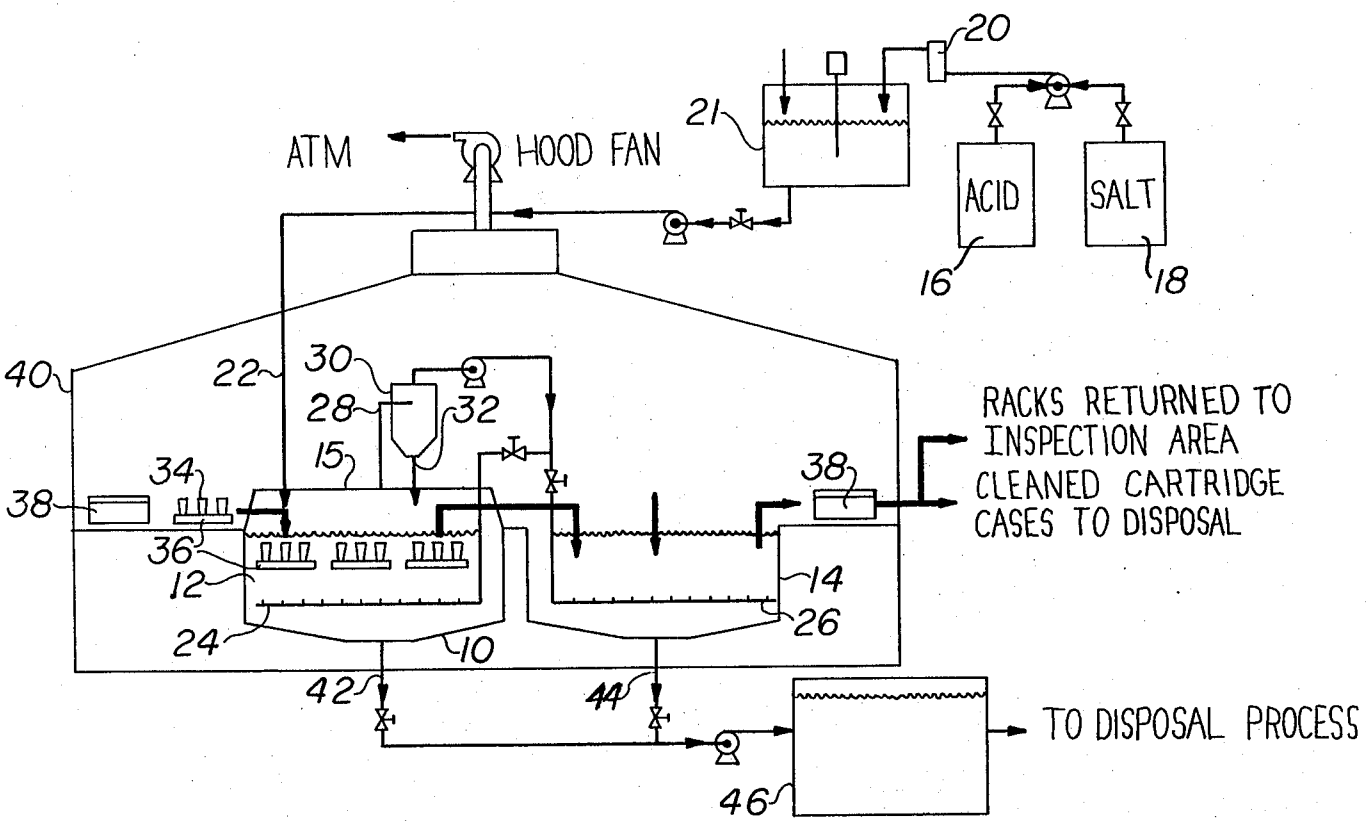
FIGURE

AQUEOUS OXIDATIVE SCRUBBER SYSTEMS FOR REMOVAL OF MERCURY

GOVERNMENTAL INTEREST

The invention described herein was made in the course of a contract with the government and may be manufactured, used and licensed by or for the Government for Governmental purposes without the payment to me of any royalty thereon.

BACKGROUND OF THE INVENTION

The present invention relates to a novel oxidative scrubber system for removing mercury from plated solid substrates and more specifically to an oxidative scrubber system comprising an aqueous solution of an alkali metal chromate or alkali metal dichromate salt in combination with nitric acid.

The present invention also relates to a process for removing mercury from solid substrates such as in an empty cartridge casing and live ammunition in a safe and economical manner by utilizing in the process the novel oxidative scrubber system.

During the manufacture of small cartridge cases, the brass cartridge cases are checked for stress concentrations and hairline cracks, which if not detected, would result in the production of unacceptable ammunition. The procedure for checking the cartridge cases, which is set forth in Federal Test Method No. 151A and Method 831, involves cleaning the cases in dilute nitric acid, followed by immersion in one percent mercurous nitrate solution. Metallic mercury plates out on the surface of the casing, preferentially in cracks or highly stressed regions. The cases are then visually inspected or heated to remove the mercury from the bulk surface, followed by visual inspection of the pyrolyzed cases. The mercury cracking test is normally part of the quality control imposed after key production steps and as a part of the final acceptance of ammunition lots.

The casings and the live ammunition failing the mercury crack test are then sent to a furnace or a Tooele Deactivation Furnace where they are melted down and redrawn. During this operation mercury vapors are emitted in the atmosphere at unacceptable levels. In an effort to avoid this emission problem, the mercury must be removed from the cartridges and ammunition before it is sent to the furnace.

While there are several systems capable of removing mercury from brass cartridge cases, they all have serious deficiencies both technically and economically. For example, systems incorporating an oxidizer with various types of acids such as hydrochloric, sulfuric and perchloric were ineffective. Also ammonium persulfate and potassium iodide chemical removal systems displayed vast inefficiencies and could not be acceptably used in a commercial operation.

Other designs were also considered, such as utilizing a vacuum oven, which pyrolyzes the mercury from the cartridge cases, in series with a mechanically refrigerated mercury trap and adsorption column. However, in order to meet the effluent guidelines, it is still found necessary to remove the mercury from the cartridge before treatment in the oven.

SUMMARY OF THE INVENTION

Accordingly, an object of the present invention is to provide a process for removing mercury from solid substrates in an economically efficient manner.

It is another object of the instant invention to provide an oxidative scrubber system which is less expensive to use than other strong oxidative systems, can be operated at ambient temperatures and permits the recovery of relatively pure mercury compound from spent scrubber solutions.

It is a further object of the invention to provide an oxidative scrubber system which is compatible with mono and double base explosive systems and is sufficiently stable so that it can be stored for long periods of time.

It is also within the ambit of the present invention to provide a process which is capable of removing mercury from unloaded brass cartridge cases and live ammunition prior to their being sent to a furnace for destruction and further processing.

These and other objects and advantages will be apparent in the detailed description to follow.

BRIEF DESCRIPTION OF THE DRAWINGS

FIG. 1 is a flow diagram for the process of the instant invention.

DETAILED DESCRIPTION OF THE INVENTION

In accordance with the present invention, a superior oxidative scrubber system for removing mercury from plated solid substrates is prepared by dissolving in water an alkali chromate or dichromate salt and then combining the solution with nitric acid.

The alkali chromate salt used can be in either the anhydrous or hydrated form. For example sodium chromate or sodium chromate decahydrate, can both be used in the present invention. The sodium dichromate salt will normally be the dihydrate form. When referring to the alkali metal chromate or alkali metal dichromate salts herein, it is to be understood that the ammonium salts and anhydrous and hydrate forms are included.

Generally any alkali metal and ammonium chromate or dichromate salt can be utilized but the potassium and sodium salts being readily available and less expensive are preferred. The aqueous solution of the chromate salts may be of any convenient concentration but concentrated solutions are preferred in order to insure that a sufficient amount of the oxidizer is available to remove the mercury from the solid substrate. If necessary in preparing the solution, the water may be heated to increase the rate of dissolution and/or the amount of salt going into the solution. The only limitation in the concentration of the salt solution would be the amount of salt that can be readily dissolved in the water.

The concentration of the nitric acid used in the system is about 1 mole per liter to about 8 moles per liter. The concentration of the oxidation salt is generally about 0.1 mole per liter to about 1 mole per liter.

In using the acid-chromate or acid-dichromate scrubber system, it was noted that the mercury could be completely removed from the solid substrate within 3 or 4 minutes without heating the solution. However, depending upon the method used to stir the oxidative scrubber system, the reagents used and the shape and size of the substrate, the solid substrate could be in contact with the system for about 1.5 minutes to about 20 minutes.

It was also noted that there was a discrepancy between the amount of mercury removed by the oxidative scrubber system and the stoichometric amount which should have been removed. One of the reasons for this discrepancy is that other materials are being oxidized. In the case of cartridge shells, the brass shell casing is oxidized along with the mercury.

Also it is believed that the oxidation reaction proceeds in accordance with the following scheme:

$$3Hg+Cr_2O_7^{-2}+14H^+ \rightarrow 3Hg^{+2}+2Cr^{+3}+7H_2O$$

Thus, it becomes very apparent that nitric acid or the free hydrogen ion content of the mercury removal solution appears to be the limiting reagent. For example, 300 mililiters of solution containing 0.6 M potassium dichromate and 2 M nitric acid would only have enough hydrogen ion present to utilize one-fourth of the dichromate oxidant. However, when fresh nitric acid is added to the spent solution, the mercury removal capability of the spent solution is only partially restored. While it is not completely understood why the spent solution would not be completely regenerated through the addition of nitric acid, it may be due to a change in the reaction mechanism, an exponential dependence of the reaction rate on reactant concentrations or the attainment of equilibrium. Regardless of the exact reason for the failure to obtain total rejuvenation of the spent solution, it does point out the importance of having enough reaction medium in the process to effectively oxidize the mercury present on the solid substrate.

Notwithstanding the apparent discrepancy between the observed and stoichometric amount of mercury removed by the oxidative scrubber system, the usage ratio of the unit mass of the chromate or dichromate salt per unit mass of mercury removed is in the order of about 20 to 30, which is very good. This compares with usage ratios of greater than 200 of other oxidative reagents. Thus, the new oxidative scrubber system offers an excellent alternative for removing mercury from solid substrates.

The following examples will more fully illustrate the embodiments of the invention. Unless otherwise specified, all parts and percentages are by weight.

EXAMPLE I

Comparison of Various Oxidizer Systems

The oxidizer and/or oxidizer-acid systems set forth in Table I are tests for removing mercury from a single mercury plated cartridge case. Either a one molar solution of oxidizer alone or a one molar solution of oxidizer with a one molar solution of acid is used.

TABLE I

| System Reaction | Results |
|---|---|
| 1. Iron nitrate; phenanthroline | No apparent reaction |
| 2. cerium nitrate | No apparent reaction |
| 3. Potassium permanganate; nitric acid | Partial removal of mercury, thick black precipitate forms at mercury surface |
| 4. Hydrogen peroxide; nitric acid with trace silver nitrate catalyst | Incomplete mercury removal |
| 5. Hydrogen perioxide; hydrochloric acid | No apparent reaction |
| 6. Hydrogen peroxide; hydrogen bromide | Partial removal of mercury; dark film forms at mercury interface |
| 7. Cobalt nitrate | No apparent reaction |
| 8. Bismuth oxide; nitric acid | No appreciable reaction |
| 9. Potassium dichromate; nitric acid | Complete removal of mercury, no detectable deposit formed at mercury solution interface |

In the following examples a laboratory scale gas sparged reactor is employed. The reactor is designed to receive a cartridge rack capable of holding 36 cartridge cases and agitating the reagents by means of gas sparge.

EXAMPLE II 260 mls of a 0.6 M potassium dichromate and 2 M nitric acid solution is added to a gas sparge reactor containing 36 mercury plated cartridge cases. The solution is agitated with nitrogen.

The reaction begins immediately and in less than two minutes the mercury is removed from the first twenty cartridges. The cleaning period for the last sixteen cartridges is about 5 and 10 minutes. The weight ratio of the oxidizer, potassium dichromate, per unit mass of mercury removed is approximately 22.

EXAMPLE III 300 mls of a 0.6 M potassium dichromate and a 2 M nitric acid solution is added to a gas sparge reactor. A rack of twelve mercury plated 30-06 caliber shell casings, which are cleaned and plated with mercury according to the ASTM crack test procedure B154-58, is then placed in the reactor. The solution is agitated with nitrogen at an average flow rate of 0.3 liter per minute. The sparge gas is at ambient temperature (about 23° C.). The reaction which begins immediately is allowed to continue for 90 seconds and the rack is raised above the solution and visually examined for the degree of completness of mercury removal. The rack is then lowered into the solution for another 90 seconds and again lifted out.

The shell casings are completely clean of mercury except in the groove at the base of some shells after the first 90 seconds. The casings are completely cleaned after the second 90 second period.

EXAMPLE IV

The process of Example III is repeated but oxidant sodium dichromate is substituted for potassium dichromate and the casings are treated for three 90 second reaction periods. The casings are completely cleaned after the third reaction period.

EXAMPLE V 300 mls of a 0.6 M sodium dichromate and a 2 M hydrochloric acid solution is added to a gas sparge reactor. A rack of twelve mercury plated 30-06 caliber shell casings which are cleaned and plated with mercury according to ASTM crack test procedure B154-58, is placed in the reactor and the solution agitated with nitrogen at an average flow rate of 0.3 liter per minute. The spurge gas is at ambient temperature (about 23° C.). The casings are permitted to react for three 90 second intervals. After the first reaction period the casings are still completely covered with mercury. After the third reaction period there is still incomplete mercury removal from the casings.

EXAMPLE VI

The process of Example V is repeated but sulfuric acid is used in place of the hydrochloric acid. There is incomplete mercury removal from the casings after the third reaction period.

EXAMPLE VII

The process of Example V is repeated but perchloric acid is substituted for the hydrochloric acid. After three reaction periods there is no visible sign of mercury removal from the casings.

EXAMPLE VIII

The process of Example III is repeated except the solution is agitated with air as opposed to nitrogen. The casings are completely cleaned after the second reaction period.

EXAMPLE IX

Comparison of Different Means of Solution Agitation and Contacting Solid Substrate Twelve mercury plated 30-06 caliber shell casings are placed in a 400 ml cylindrical beaker and covered with 300 mls of a 0.6 M potassium dichromate and 2 M nitric acid solution. The solution is stirred by using a 2.5 cm long Teflon coated magnetic bar and magnetic stirrer motor. A stirrer speed of about 100–300 rpm is used. The shell casings are allowed to react for 15 minutes in the stirred solution. The shell casings are then removed from the solution and rinsed in de-ionized water. Approximately one half of the total shell casings surfaces are cleaned of mercury.

EXAMPLE X 300 mls of a 0.6 M potassium dichromate and 2 M nitric acid solution is loaded into a fluorocarbon paint sprayer. The solution is aspirated by passing the pressurized fluorocarbon gas over an orifice of a capillary delivery tube immersed in the solution reservoir. The solution is aspirated in a fine mist onto twelve mercury plated 30-06 caliber shell casings mounted vertically on a rack. The aerosolized solution is applied to the casings continuously for about 10 to 15 seconds once every minute until the entire 300 mls of solution is aspirated. The spray is held at a distance of 15–30 cm from the rack. After each application of the solution the casings are rinsed in order to remove a precipitate forming on the surface of the casings. The casings show a uniform removal of mercury although no one shell casing is completely cleaned of mercury.

While it appears that the mercury removal reaction can be implemented in a conventional mechanical stirred reactor and a spray type reactor, it is also apparent that if a non-uniform or ineffective means of contacting is used, wherein a large surface becomes exposed to the solution before less stirred small surface regions are cleaned of mercury a significantly larger amount of reagent may be required to clean a unit.

EXAMPLE XI

Efficiency of Acid-Dichromatic System 30-06 caliber brass cartridge cases in groups of twelve are degreased, pickled and plated with mercury according to ASTM procedure B-154-58 for mercury crack testing. Four groups of twelve of the mercury plated cartridge cases are then placed in four separate racks and weighed.

A gas sparged reactor is filled with 300 mls of a solution consisting of 0.8 M potassium dichromate and 2 M nitric acid. A rack of twelve cartridge cases is then placed in the reactor and nitrogen gas flowing at a rate of about 300 liters/minute is used to agitate the solution. The reaction is permitted to continue until the solution can not completely remove mercury from the cartridge cases in a fifteen minute reaction period. It is observed that the 300 mls of solution completely removed all of the visible mercury from three racks and a good fraction from a fourth rack. The first two racks of mercury coated cases are cleaned in less than two minutes. The third rack in fifteen minutes and the fourth rack is partially cleaned in twenty minutes.

After the racks of cartridge cases are removed they are drained of solution, flushed with deionized water, rinsed in acetone and dried in streams of nitrogen gas. The cartridge cases are then placed in a dessicator for sixteen hours and weighed. After the fourth rack is removed from the reactor, the contents of the reactor are drained and the reactor flushed with deionized water. The washings and the original contents are combined and filtered and the filtrate diluted to a standard volume in an volumetric flask. The filtered precipitate and filter paper are redissolved in nitric acid and the solution diluted to a standard volume. Both product solutions are analyzed for chromium, copper, mercury and zinc content by atomic absorption spectroscopy.

The weight measurements and mass changes observed after each treatment in the mercury plating and removal steps are shown in Table II. Table III reports the results of the analysis of the spent solution and precipitate.

TABLE II

| Operation | Rack I | Rack II | Rack III | Rack IV |
|---|---|---|---|---|
| | Mass Measurement | | | |
| weight after degreasing | 153.3581 g | 154.1902 g | 154.1255 g | 154.2779 g |
| pickling | 142.1283 g | 146.3868 g | 143.9012 g | 146.6522 g |
| mercury plating | 143.0000 g | 147.2897 g | 144.8162 g | 147.5715 g |
| mercury removal | 140.1541 g | 144.5890 g | 140.8910 g | 143.6693 g |
| | Mass Changes | | | |
| Pickling | 11.2298 g | 7.8034 g | 10.2243 g | 7.6257 g |
| | −7.32% | −5.06% | −6.63% | −4.94% |
| Mercury Plating | 0.8717 g | 0.9029 g | 0.9150 g | 0.9193 g |
| | 0.613% | 0.617% | 0.636% | 0.627% |
| Mercury Removal | 2.8459 g | 2.7007 g | 3.9252 g | 3.9022 g |
| | −2.03% | −1.83% | −2.71% | −2.64% |

Pooling the mass change data for the plating operation gives an average value of 75.2 milligram change per cartridge case. The average amount of mercury deposited is calculated to be about 89.5 milligrams.

TABLE III

| Spent Solution |
|---|

TABLE III-continued

| Element | Concentration ppm | Concentration molarity | Weight Grams | Milli-moles | Milli-Equivalents |
|---|---|---|---|---|---|
| Chromium | 86,000 | 1.65 | 25.7 | 490 | |
| Copper (+2 oxidation state) | 21,000 | 0.33 | 6.3 | 99 | 198 |
| mercury (+2 oxidation state) | 820 | 0.0042 | 0.1 | 0.5 | 2.4 |
| Zinc | 9,300 | 0.14 | 2.8 | 43 | 86 |

| Element | Spent Solution Precipitate Millimoles | Milli-Equivalents | Weight - gms. |
|---|---|---|---|
| Chromium | 14 | | 0.70 |
| Copper (+2 oxidation state) | 0.4 | 0.80 | 0.025 |
| Mercury (+2 oxidation state) | 15.5 | 30.9 | 3.1 |
| Zinc | 0.15 | 0.30 | 0.010 |

The number of grams of metal removed by the solution is approximately 12.3 grams as determined from the sum of the weights of copper, mercury and zinc found in the spent solution and precipitate. This correlates well with the 13.4 gram value determined from the sum of the mass changes measured for each rack of cartridge cases. A lack of better correlation may be due to the presence of an adhering black precipitate observed on the fourth rack of cartridges.

The weight of potassium dichromate to the weight of mercury removed is approximately 23.4 which is very good.

EXAMPLE XII

Compatibility Testing of Live Ammunition

Five 0.1 gram samples of DuPont IMR 8208-M single base propellant and five 0.1 gram samples of Olin WC 844 double base propellants are placed in separate hot plate depressions exposed to the atmosphere and saturated with a nitric acid-potassium dichromate solution. After 10 minutes the samples are then linearly heated until deflagration occurs. No reaction is observed at room temperature or temperatures less than 100° C. Deflagration also does not occur until complete evaporation of the liquid from the samples.

The above procedure is repeated except the samples are not saturated with the acid-dichromate solution. The results are the same for both doped and undoped propellants.

A process for removing mercury from inert cartridge cases and live rounds of ammunition will be more fully understood by referring to the figure.

As illustrated in FIG. I, the process utilizes a closed reactor tank 10, which contains the oxidative scrubber solution 12, and a rinse tank 14, which contains water. The reactor tank has a removable lid 15 to facilitate the placing and removal of mercury coated solid substrates. The scrubber solution, which for example may be nitric acid and potassium dichromate, is prepared by pumping the acid and oxidant from tanks 16 and 18 respectively through a totalizer flow meter 20 into a solution tank 21 to prepare a solution of fixed concentration. The solution is then pumped into the reactor through pipe 22.

The solution is agitated by means of a gas, such as air, which is pumped through a pipe 24 located at the bottom section of the reactor 10. Air is also pumped into the rinse tank 14 through pipe 26. After the air circulates through the solution 12 it leaves through a pipe 28 and enters a mist eliminator 30 where the solution trapped in the air is released and recycled back into the reactor through pipe 32.

In operation the process racks 36, loaded with mercury coated material such as cartridge casings and live ammunition 34, are collected from various quality control laboratories and transported to a central mercury removal facility. The racks 36 are placed in containers 38 to protect personnel during transportation to the central treatment center. At the center, the racks 36 are removed from the containers 38 and placed in a rack holder, not shown, for lowering into the reactor tank 10 containing the oxidative scrubber solution 12. After the racks 36 are lowered into the reactor 10, the lid 15 is closed and the air turned on to agitate the scrubber solution 12. After a predetermined reaction time the racks 36, now containing mercury free cartridge casings and ammunition 34, are removed from the reactor 10 and washed in the rinse tank 14. The clean cartridge casings or live rounds of ammunition 34 are then sent to a deactivation furnace (not shown) and the empty racks 36 and containers 38 are returned to their quality control laboratories.

In order to protect personnel, the entire loading and unloading process occurs under a hood 40 and the nitric acid fumes and mercury vapor vented.

The spent scrubber solution 12 and rinse water can be emptied from the reactor 10 and the rinse tank 14 through pipes 42 and 44 respectively and pumped to a waste holding tank 46 for ultimate disposal.

Further details of the process can be best understood by referring to the following example.

EXAMPLE XIII

A process is designed to remove 500 pounds of mercury annually from inert brass cartridge casings and live rounds of ammunition. A total of 6,000 gallons of 0.8 M potassium chromate and 2.0 M of nitric acid solution is required per year. Referring to the figure, solution make up tank 21 holds 1000 gallons of reactant. Approximately every two months the 1,000 gallons of reactant will be spent and a new batch is prepared.

Three racks of mercury coated cartridge casings and live ammunition rounds are lowered into a reactor tank holding 65 gallons of agitated reactant for approximately 15 minutes. The racks are then washed in a 65 gallon rinse tank. The cycle is continuously repeated with other racks until the solution is spent, which is determined when it reaches a pH of about 1.8 or upon the formation of a precipitate. After the solution is spent, it and the rinse water is pumped into a 3,000 gallon waste holding tank. This tank is emptied approximately four times a year.

While the process was explained in terms of removing mercury from cartridge casings and live ammunition, it will be understood that the process will be equally applicable to removing mercury from any solid substrate.

Also, this invention has been described with respect to certain preferred embodiments and various modifications. Variations in the light thereof will be suggested to persons skilled in the art and are to be included within the spirit and purview of this application and the scope of the appended claims.

What is claimed is:

1. A process for removing mercury from plated solid substrates comprising the steps of contacting said solid substrate with an aqueous solution of an oxidative salt and nitric acid in a ratio by weight of from about 1.4 to about 4 for a period sufficient to remove mercury from said substrate, and then removing the solid substrate from the solution, said oxidative salt being selected from the group consisting of alkali metal and ammonium chromate and alkali metal and ammonium dichromate.

2. The process of claim 1, wherein the oxidative salt is potassium dichromate or potassium chromate.

3. The process of claim 1, wherein the oxidative salt is sodium dichromate or sodium chromate.

4. The process of claim 1, wherein the oxidative salt is ammonium dichromate or ammonium chromate.

5. The process of claim 1 wherein the concentration of the nitric acid is from about 1 mole per liter to about 8 moles per liter.

6. The process of claim 1, wherein the unit mass of the oxidative salt used per unit mass of mercury removed from the solid substrate is from about 20 to 30.

7. The process of claim 1, wherein the treated solid substrate is rinsed with water after being contacted with the solution.

8. The process of claim 1, wherein the solid substrates are selected from the group consisting essentially of empty brass cartridge casings, live ammunition rounds and combinations thereof.

9. The process of claim 1, wherein the oxidative salt is potassium dichromate or sodium dichromate.

10. The process of claim 9, wherein the amount of oxidative salt is from about 0.6 mole to about 0.8 mole per liter and the amount of nitric acid is about 2 moles per liter.

* * * * *